US007503606B2

(12) United States Patent
Hall et al.

(10) Patent No.: US 7,503,606 B2
(45) Date of Patent: Mar. 17, 2009

(54) LIFTING ASSEMBLY

(76) Inventors: David R. Hall, 2185 S. Larsen Pkwy., Provo, UT (US) 84606; Jay Reynolds, 2185 S. Larsen Pkwy., Provo, UT (US) 84606; David Fox, 2185 S. Larsen Pkwy., Provo, UT (US) 84606; Thomas Morris, 2185 S. Larsen Pkwy., Provo, UT (US) 84606

( * ) Notice: Subject to any disclaimer, the term of this patent is extended or adjusted under 35 U.S.C. 154(b) by 443 days.

(21) Appl. No.: 11/422,291

(22) Filed: Jun. 5, 2006

(65) Prior Publication Data

US 2008/0006806 A1 Jan. 10, 2008

(51) Int. Cl.
*B66C 1/22* (2006.01)

(52) U.S. Cl. ..... 294/81.52; 294/81.56; 294/81.6; 294/907

(58) Field of Classification Search ..... 294/81.52, 294/81.53, 81.56, 81.6, 81.61, 81.62, 67.32, 294/907, 82.15
See application file for complete search history.

(56) References Cited

U.S. PATENT DOCUMENTS 1,765,023 A * 6/1930 McWane ..... 294/81.52
1,767,525 A * 6/1930 Hoffman ..... 294/81.52
3,154,338 A * 10/1964 Leach ..... 294/88
3,596,970 A * 8/1971 Levert et al. ..... 294/81.2
3,677,599 A * 7/1972 Shannon ..... 294/81.53
3,976,321 A * 8/1976 Dean ..... 294/81.52
4,008,814 A * 2/1977 Kral et al. ..... 414/281
4,432,691 A 2/1984 Sterner
4,531,875 A 7/1985 Krueger
4,604,724 A 8/1986 Shaginian
4,975,018 A * 12/1990 Langenbacher et al. 198/750.11
5,184,861 A 2/1993 Voellmer
6,305,728 B1 * 10/2001 Holter et al. ..... 294/3
6,820,849 B2 11/2004 Kennard
6,846,331 B2 1/2005 Senoir

* cited by examiner

*Primary Examiner*—Dean J Kramer
(74) *Attorney, Agent, or Firm*—Tyson J. Wilde; Benjamin T. Miskin

(57) ABSTRACT

In one aspect of the present invention, a lifting assembly has a frame structure with a translatable support element. The support element has a load-bearing surface and a screw-form. The screw-form is threadedly connected to a gear which is in mechanical communication with a power source, which may be an electric motor. The load-bearing surface is fixed to a shaft of the translatable support element and at least a portion of the load-bearing surface is angularly oriented with respect to the shaft. A guide with at least one end fixed to the frame structure is adapted to adjust the rotational orientation of the load-bearing surface.

17 Claims, 17 Drawing Sheets

LIFTING ASSEMBLY

BACKGROUND OF THE INVENTION

The present invention pertains to lifting assemblies, specifically lifting assemblies used in manufacturing and material handling. While transporting large objects a lifting assembly may be desired. In the prior art, several references disclose apparatuses and methods for handling objects of varying size and weight.

U.S. Pat. No. 4,432,691, which is herein incorporated by reference for all that it contains, discloses a self-contained power-operated manipulator for piping and the like and is capable of coordinated movements which approximate those of the human arm and hand.

U.S. Pat. No. 5,184,861, which is herein incorporated by reference for all that it contains, discloses a split rail gripper for robotic apparatus and including a pair of rails which are driven in mutually opposite directions by a rack and pinion gear mechanism. Each rail includes a set of rack gear teeth which engage respective pinion gears and where the top rail engaging one of the pinion gears is driven by a harmonic gear reduction drive and motor unit coupled to a drive screw. The other pinion gear is driven by the top pinion gear engaging a set of rack gear teeth included in the bottom rail. As the top rail is driven in or out, the upper pinion gear is rotated, causing the other pinion gear, in turn, to rotate in the opposite direction. This causes the bottom rail to move in an opposite linear direction relative to the top rail. An outwardly extending gripper finger assembly is attached to respective ends of the rails, with each gripper finger including an arrangement of vertically and horizontally mounted roller members which operate to automatically center and engage an H-plate type interface secured to the object being grasped. The gripper assembly also includes a base plate attached to an interface plate of a robotic tool changer mechanism. A retractable rotary tool driver and tool is also centrally mounted on the base plate.

U.S. Pat. No. 6,820,849, which is herein incorporated by reference for all that it contains, discloses a clamping device including a fixed jaw attached to one end of a threaded shaft and an adjustable jaw which is movably mounted on the threaded shaft.

U.S. Pat. No. 4,604,724, which is herein incorporated by reference for all that it contains, discloses an automated apparatus for handling elongated well elements such as pipes. An automatic tong is provided for screwing and unscrewing pipes from a string of elongated well elements. A manipulator grips and delivers a pipe to an operation position in axial alignment with the well bore. A control system includes position sensors for sensing the position of a well pipe. The control unit also includes a programmed logical control unit through which the sensors are connected to a drive system.

U.S. Pat. No. 4,531,875, which is herein incorporated by reference for all that is contains, discloses an automated pipe handling system for providing increased safety and to minimize the number of workmen required in the coupling and uncoupling of pipe stands. The system includes a programmable controller for monitoring and/or controlling devices which remove and add pipe stands to a drill column. A number of transducers are operatively connected to the controlled devices for communication with the programmable controller for use in verifying that the controlled devices have properly performed their programmed tasks. The controlled devices include upper and lower arm assemblies for use in engaging and moving the uncoupled pipe stands to a storage position. The controlled devices further include a finger board assembly and a set-back assembly. The finger board assembly moves and retains the upper portions of the pipe stands while a drill rig floor of a derrick supports their lower portions. The set-back assembly is used to hold the lower portions of the pipe stands and to move the pipe stands to the predetermined storage positions on the drill rig floor.

U.S. Pat. No. 6,846,331, which is herein incorporated by reference for all that it contains, discloses a gripper device comprising at least two portions which are coupled together and which may be moved towards one another to effect a gripping action and away from one another to effect a release action. An electrical motor is arranged to effect such movement, and a battery is connected to supply electrical current to the motor. A capacitor device is also connected to be capable of supplying electrical current to the electrical motor. A control device is arranged to cause the capacitor device to supply electrical current to the electrical motor after supply of electrical current to the electrical motor by the battery, to increase the strength of the gripping action.

BRIEF SUMMARY OF THE INVENTION

In one aspect of the present invention a lifting assembly has a frame structure with a translatable support element. The support element has a load-bearing surface and a screw-form. The screw-form is threadedly connected to a gear which is in mechanical communication with a power source. The gear may be in mechanical communication with the power source via secondary gears, belts, bands, wheels, pulleys, chains, ropes, rods, shafts or combinations thereof. In some aspects of the invention, the power source may be fixed to the frame and may be a motor or hydraulics. The load-bearing surface is fixed to a shaft of the translatable support element and at least a portion of the load-bearing surface is angularly oriented with respect to a shaft of the support element. A guide with at least one end fixed to the frame structure is adapted to adjust the rotational orientation of the load-bearing surface. In some embodiments of the invention, the frame structure may have a stabilizing element fixed to its underside.

In some embodiments, of the invention, the guide may be a recess formed in a sleeve disposed around the shaft of the translatable support element and may be adapted to receive a guide pin fixed to the shaft. The guide may be adapted to rotate the shaft a full turn, a half turn, a quarter turn, a fractional turn, or combinations thereof.

In other embodiments, the load-bearing surface may be supported by a pivot, and a guide pin positioned within the guide may be adapted to move the load-bearing surface.

The lifting assembly may have at least one clamping assembly also attached to the frame structure which may have opposed jaws with a ball and socket apparatus intermediate a clamp end and a pivot end attached to a frame structure. The ball and socket apparatuses may be connected by a gear assembly which has a primary gear in mechanical communication with a second power source, wherein the jaws are actuated in accordance with the rotation of the primary gear.

The lifting assembly may have at least one sensor attached to the frame structure adjacent to the support element and adapted to determine a characteristic of the support element. The sensor may be a pressure sensor, a position sensor, a torque sensor or combinations thereof. In some embodiments, the at least one sensor may be part of a closed loop system.

The load-bearing surface may be angularly fixed to the shaft of the translatable support element at 5 to 145 degrees. The translatable support element may be adapted to translate along an axis offset from the axial length of the frame structure by 45 to 135 degrees. The offset axis may be normal to the axial length. The load-bearing surface may have a gripping surface selected from the group consisting of elastomer coated surfaces, grooved surfaces, curved surfaces, and rough surfaces.

In another aspect of the invention, the lifting assembly may have a frame structure with opposing translatable support elements, each with a load-bearing surface and a screw-form, the screw-form being threadedly connected to a gear in mechanical communication with a power source. Each load bearing surface is fixed and angularly oriented with respect to a shaft of each translatable support element. A guide with at least one end fixed to the frame structure may be adapted to adjust the rotational orientation of each load-bearing surface. Each guide may be a recess formed in a sleeve disposed around the shaft of the translatable support element and may be adapted to receive a guide pin fixed to the shaft.

DETAILED DESCRIPTION OF THE INVENTION AND THE PREFERRED EMBODIMENT

Figure 1:
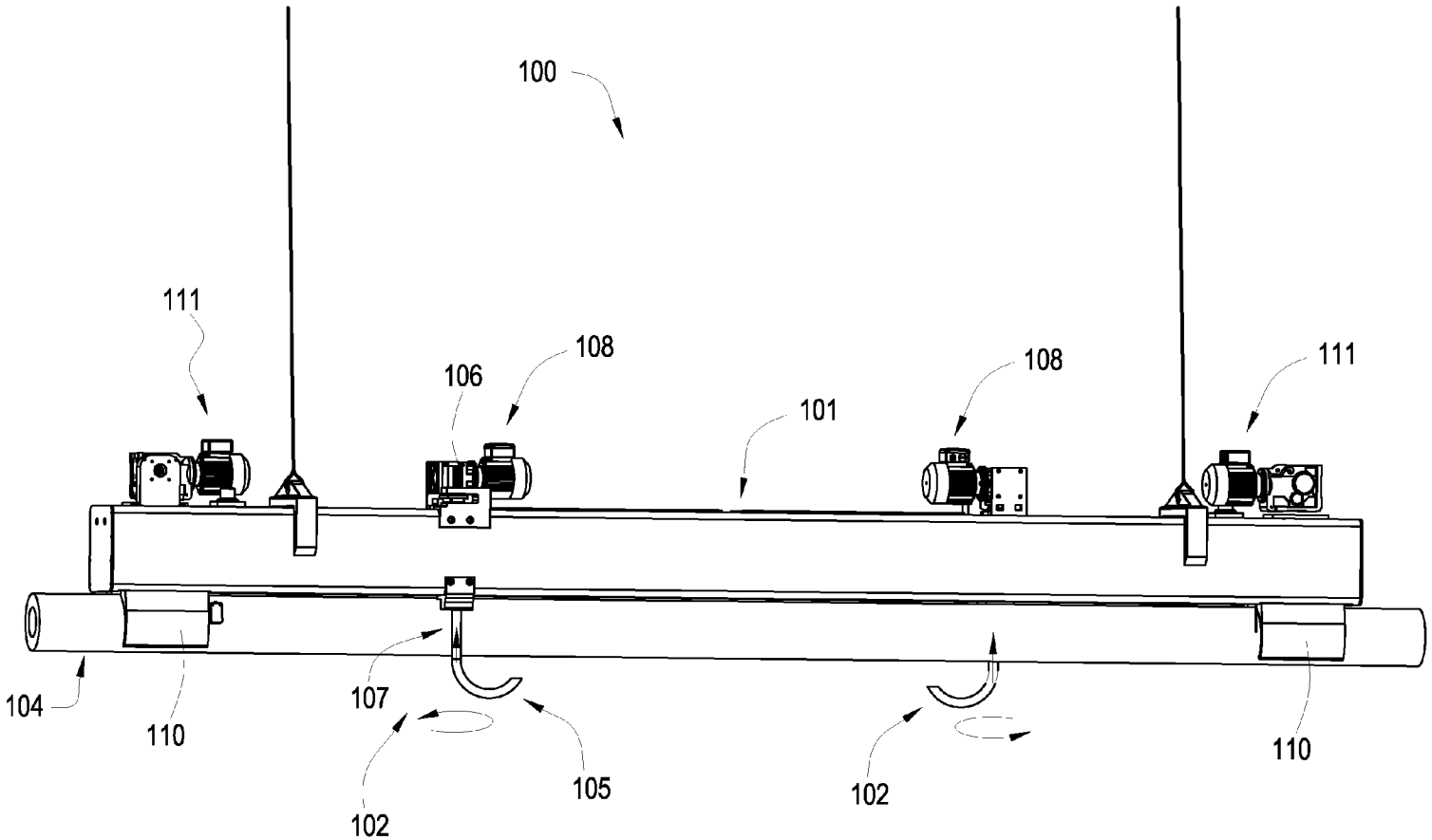
FIG. 1 is a perspective diagram of an embodiment of a lifting assembly.
Figure 2:
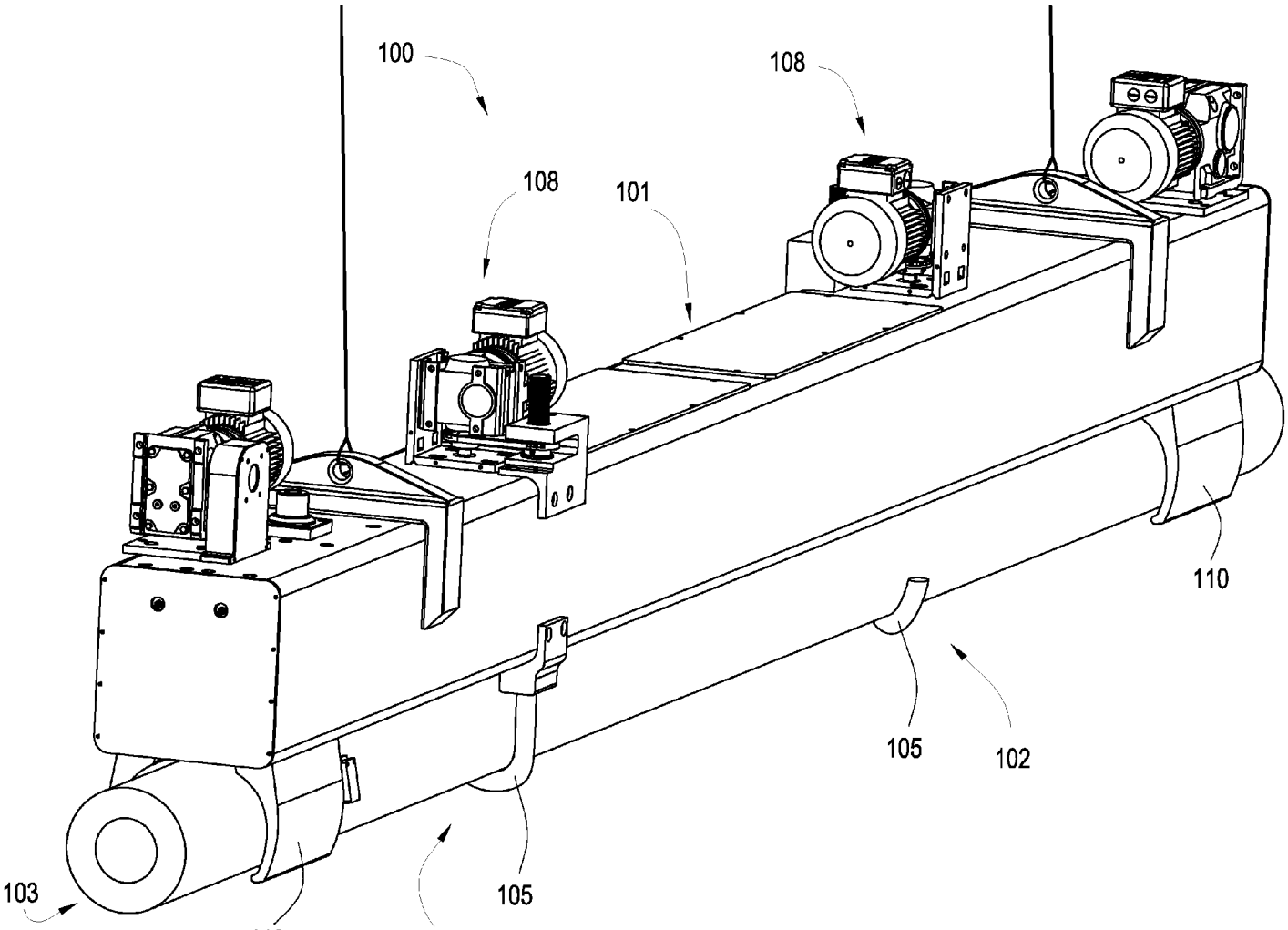
FIG. 2 is a perspective diagram of another embodiment of a lifting assembly.

Referring to FIGS. 1 and 2, a lifting assembly 100 comprises a frame structure 101, which comprises translatable support elements 102 actuated by power sources 108. Each support element 102 comprises a load-bearing surface 105 and a screw-form 106. The load-bearing surface 105 is fixed to a shaft 107 of the support element 102 and at least a portion of the load-bearing surface 105 is angularly oriented with respect to the shaft 107. The support elements 102 may be oriented in opposite directions on opposite sides of the frame structure 101. The lifting assembly may comprise at least one clamping assembly 110 actuated by a power source 111. The screw form 106 may be formed in the shaft 107 of the support element 102.

In FIG. 1, the support elements 102 are shown in a disengaged position with the load-bearing surfaces 105 positioned such that they do not interfere with the clamping assemblies 110 gripping an object 104. After a firm grip by the clamping assemblies has been established, the load-bearing surfaces 105 may then be translated upward along an axis while rotating the load bearing surface into an engaged position underneath the object 104 such that the support element supports the object. This configuration may be advantageous since the clamping assemblies 110 may act as primary grippers while the support elements 102 may act as a back-up support. The support elements of FIG. 2 are shown supporting the object.

The power sources 108 used to move the support element may be controlled by electronic equipment disposed within and/or fixed to the frame structure 101 of the lifting assembly 100. The electronic equipment may comprise sensors adapted to receive data regarding position or other characteristics of the support elements 102 or the object 104 being gripped. The sensors may be selected from the group consisting of torque sensors, pressure sensors, position sensors, strain sensors, optical sensors, sonic sensors, seismic sensors, acoustic sensors, inductive sensors, capacitive sensors, magnetic sensors, temperature sensors, vibrations sensors, sway sensors, smart sensors, and weight sensors.

Figure 3:
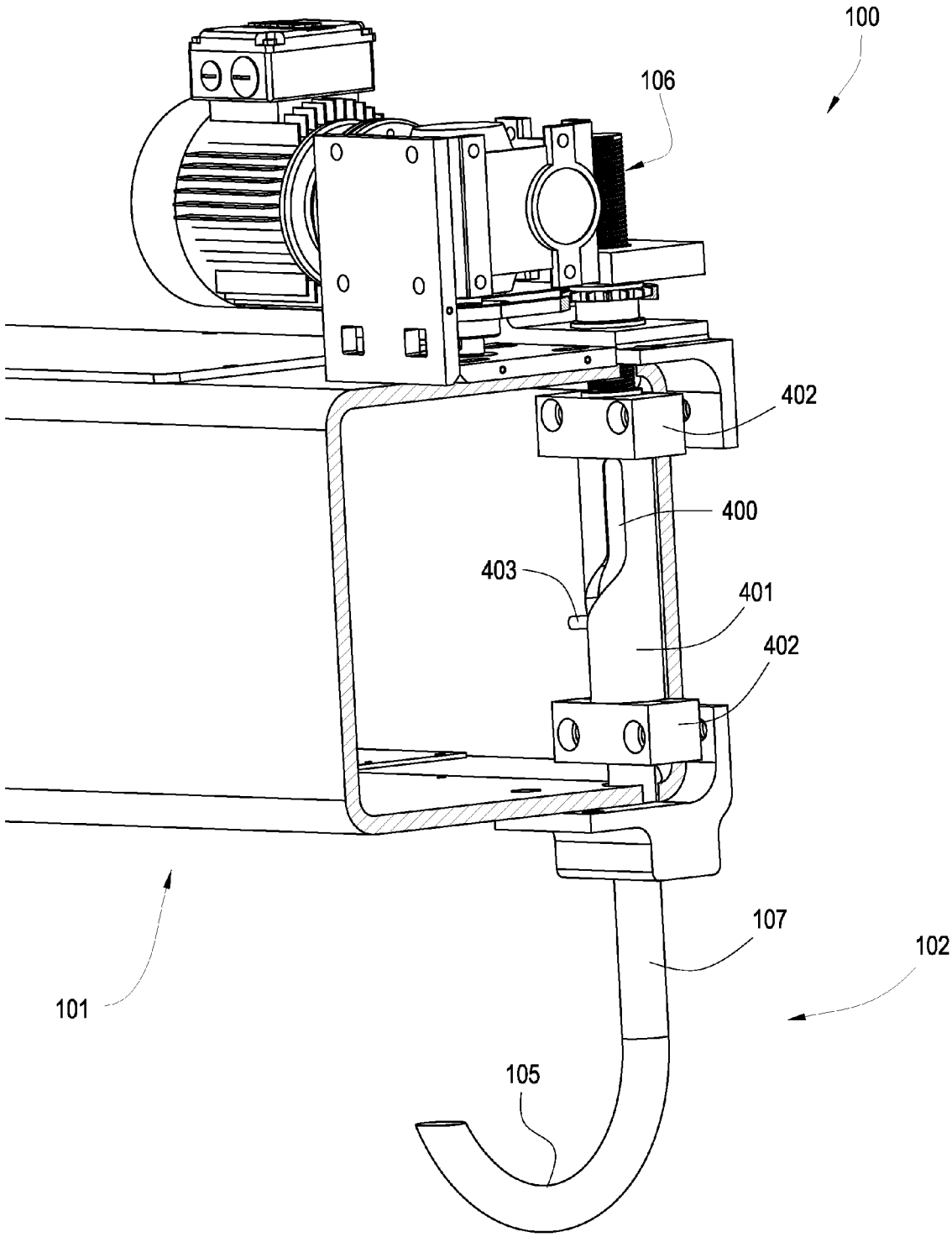
FIG. 3 is a cross-sectional diagram of an embodiment of a lifting assembly comprising a translatable support element.

FIG. 3 is a cross-sectional diagram of an embodiment of a lifting assembly 100. A support element 102 is supported by the frame structure 101 and comprises a screw form 106, a shaft 107, and a load-bearing surface 105. A sleeve 401 is disposed around the shaft and guide 400 is formed in the sleeve. At least one end 402 of the sleeve may be attached to the frame structure 101. The guide may be adapted to receive a guide pin 403 fixed to the shaft 107. In this embodiment, as the support element 102 is moved from the disengaged position to the engaged position, the guide pin follows the guide, causing the load-bearing element 105 to rotate.

Figure 4:
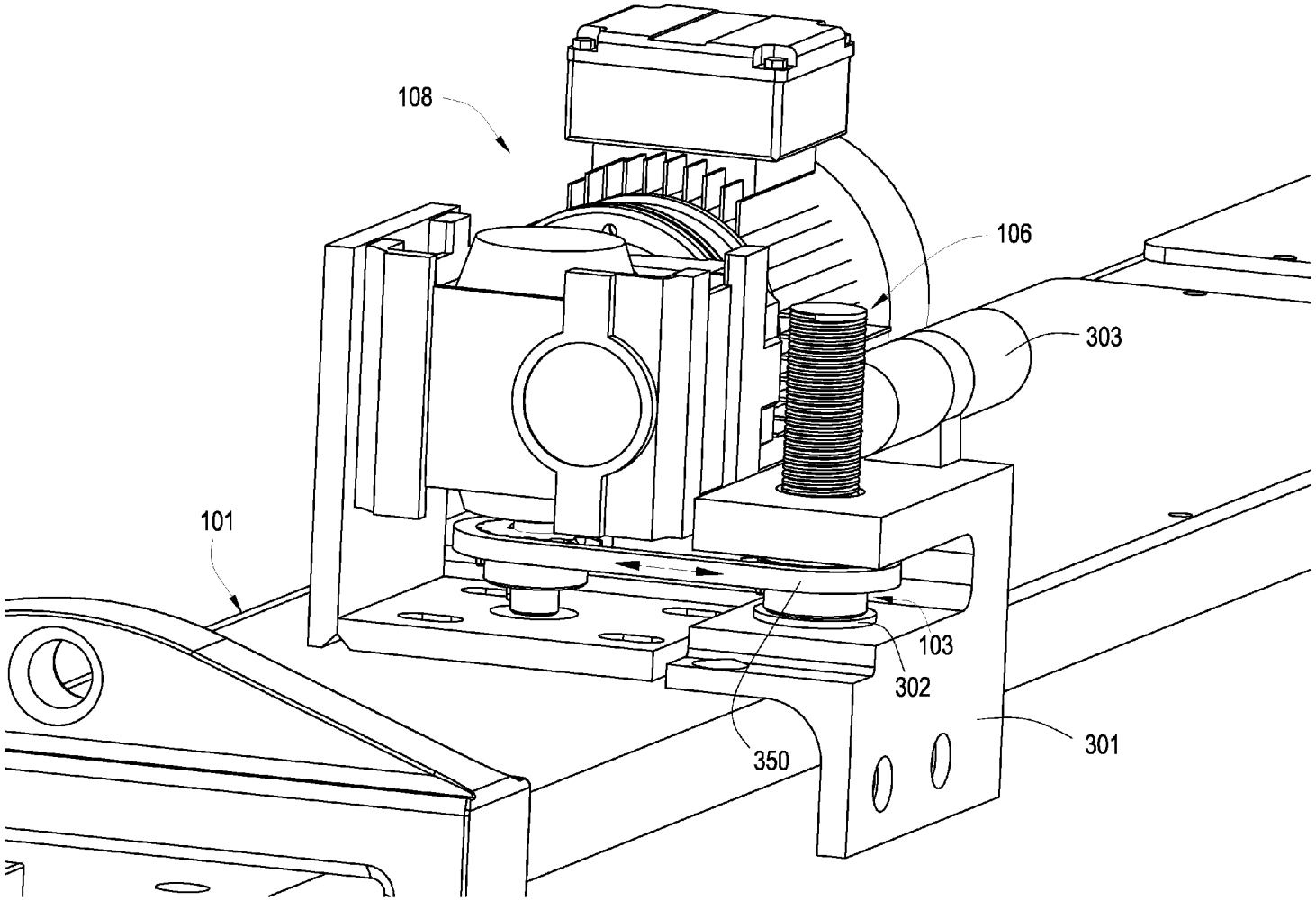
FIG. 4 is a perspective diagram of an embodiment of a gear in mechanical communication with a power source.

FIG. 4 is a perspective diagram of an embodiment of the screw-form 106 of a support element 102 threadedly connected to a gear 103 in mechanical communication with a power source 108. The power source 108 of the embodiment shown in FIG. 3 is a motor. The power source may be fixed to the frame structure. The gear may be secured by a clamp 301 to the frame structure 101 while being allowed to rotate. A bushing 302 or ball bearing may facilitate the rotation of the gear. The gear may be in mechanical communication with the power source via secondary gears, belts 350, bands, wheels, pulleys, chains, ropes, rods, shafts or combinations thereof In this embodiment, the support element 102 moves up or down in accordance with the rotation of the gear 103. A sensor 303 may be fixed to the frame structure 101 which may determine the position of the screw-form 106 of the support element 102 in relation to the frame structure. The sensor 303 may be a barrel proximity sensor. The electronic equipment may turn the power source on or off, or adjust the speed of the power source 108 depending on the position of the screw-form.

The threaded connection between the gear 103 and the screw-form 106 may be advantageous as the threaded connection may provide adequate support for an object being carried by the lifting assembly 100 under static loads, which makes the support element 102 a good safety feature. In this embodiment, if the power supply 108 were to fail, the threaded connected between the gear and support element would be able to hold the weight of the object 104.

Figure 5:
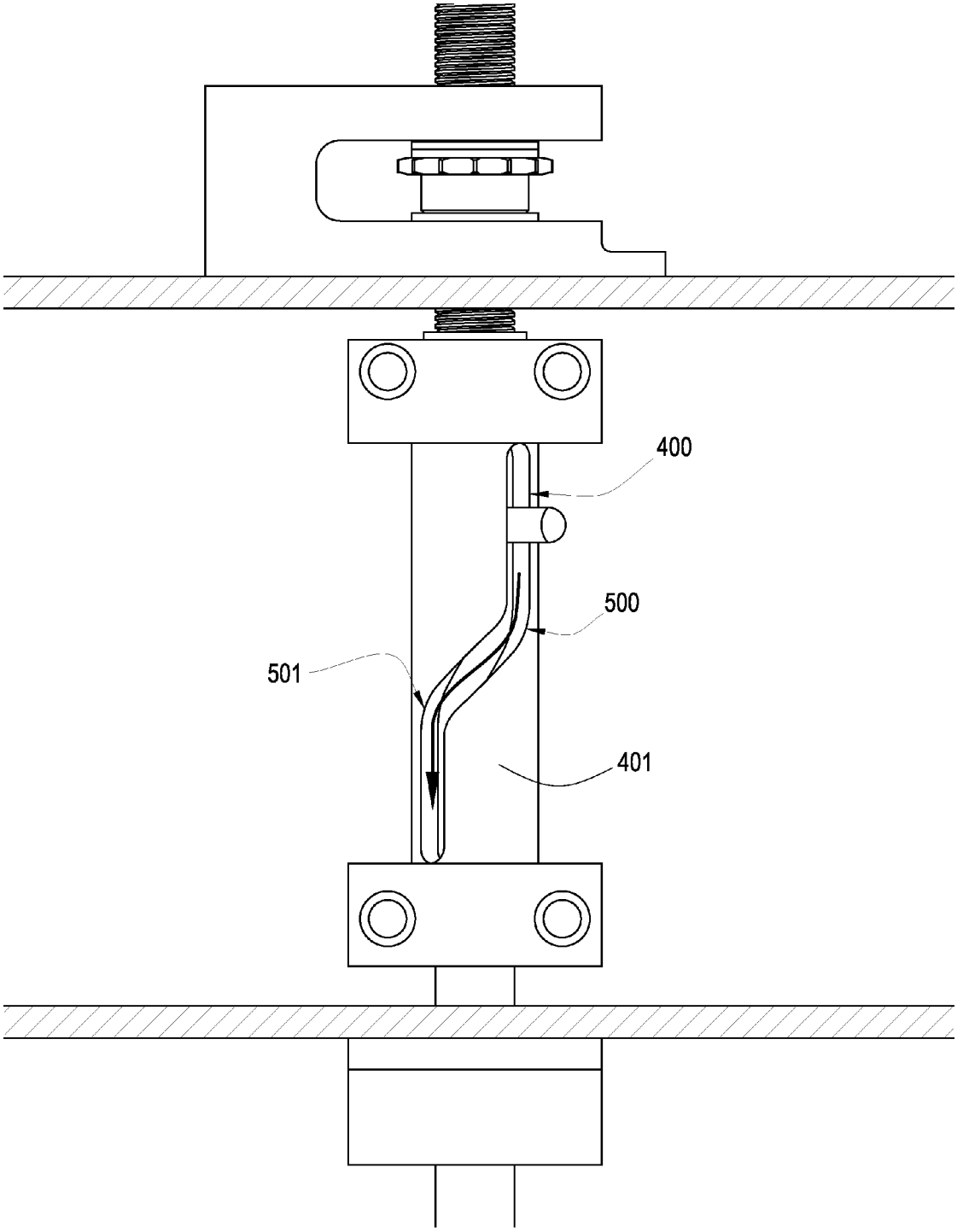
FIG. 5 is a perspective diagram of an embodiment of a guide.

FIG. 5 is a perspective diagram of an embodiment of a guide 400 formed in the sleeve 401. In the case of the support element 102 translating down, the shape of the guide is such that a guide pin 403 fixed to the support element will reach an angled portion 500 of the guide rotating the support element as it translates vertically. The guide pin then reaches another portion 501 of the guide where its rotation stops and the support element continues moving vertically along the guide.

In some embodiments, the guide 400 may have gradual transitions between the angled portions 500, 501 and the vertical portions such that the guide pin 403 doesn't gall the guide wall or damage the guide pin. Although FIG. 5 discloses a guide which allows the load-bearing surface to turn a quarter turn, other guides may be used which allow a half turn, full turn, fractional turn, or combinations thereof.

Figure 6:
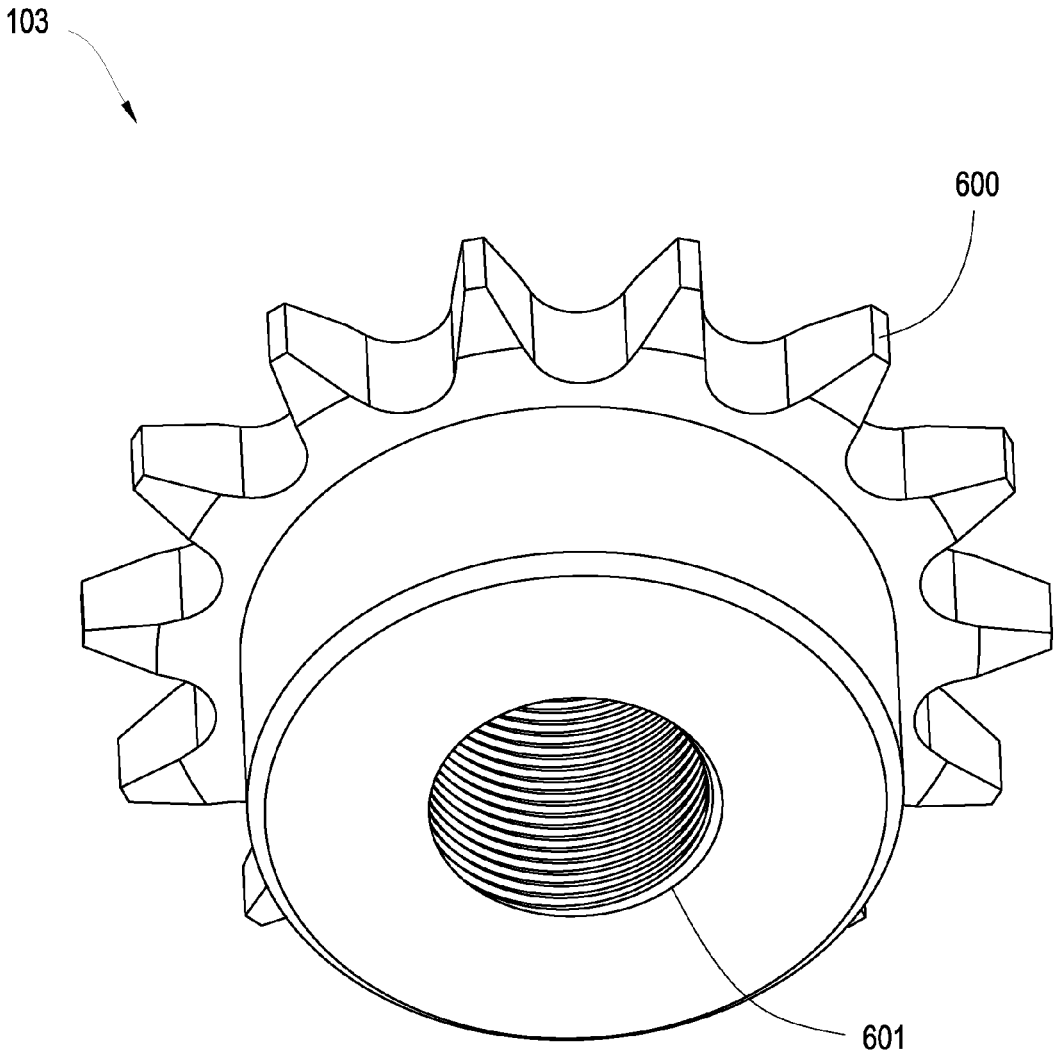
FIG. 6 is a perspective diagram of an embodiment of a gear.
Figure 7:
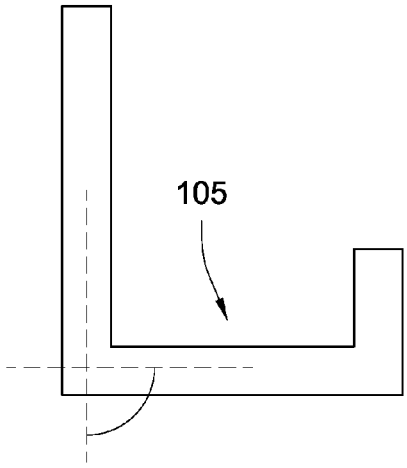
FIG. 7 is a perspective diagram of an embodiment of a load-bearing surface.
Figure 8:
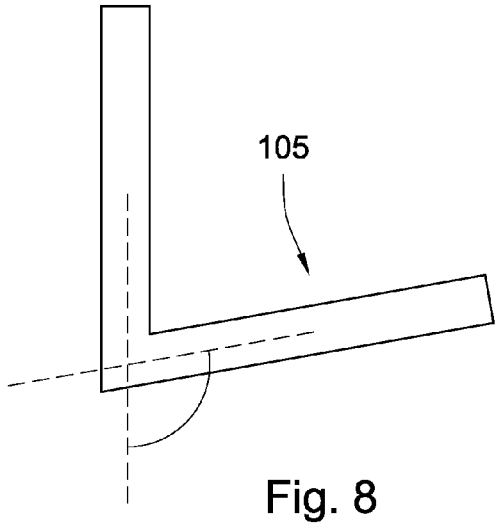
FIG. 8 is a perspective diagram of another embodiment of a load-bearing surface.
Figure 9:
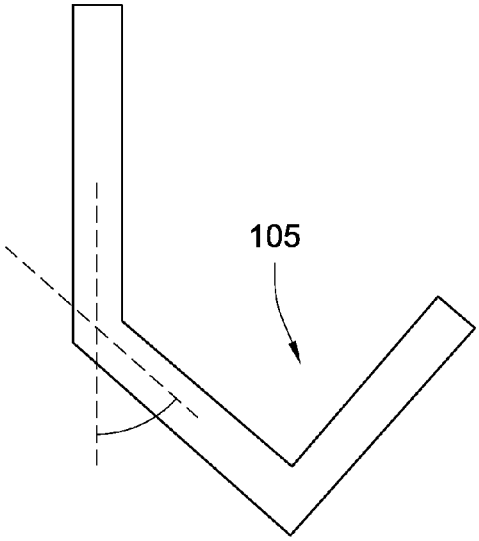
FIG. 9 is a perspective diagram of another embodiment of a load-bearing surface.
Figure 10:
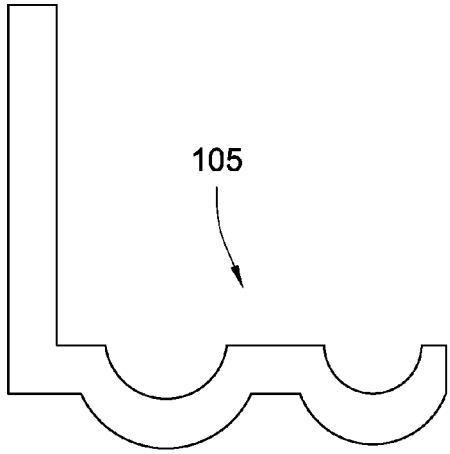
FIG. 10 is a perspective diagram of another embodiment of a load-bearing surface.

FIG. 6 discloses a gear 103 which may be used in the present invention. The inner diameter 601 of the gear may be threaded to allow a threaded connection with a screw-form 106 of a support element 102. A portion of the gear may comprise teeth 600 which allow interaction with belts 350 or chains. The threads on the screw-form and the gear may have a small enough pitch such that friction is sufficient to prevent unwanted movement of the support element.

FIGS. 7, 8, 9, and 10 disclose alternative embodiments of the load-bearing surface 105 of a support element 102. A portion of the load-bearing surface may be fixed to the shaft 107 of the support element 102 at any angle from 5 to 145 degrees. The load-bearing surface may comprise any size, length, shape, or material composition. The load-bearing surface may be a hook, as in the embodiment of FIG. 1.

Figure 11:
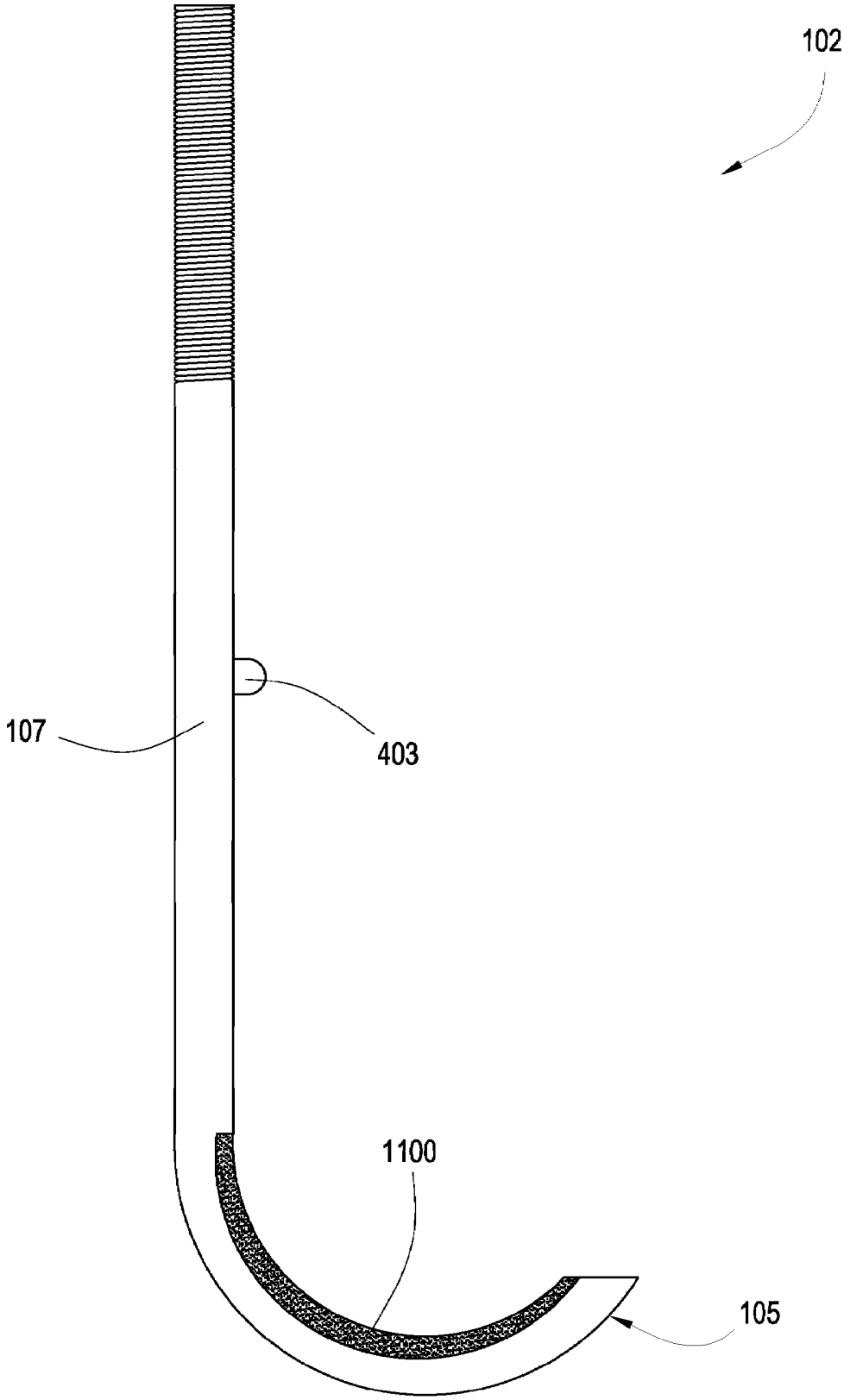
FIG. 11 is a perspective diagram of another embodiment of a support element.

FIG. 11 discloses an embodiment of a support element 102. The support element may comprise a guide pin 403 fixed to a shaft 107. The guide pin may be adapted to fit within a guide 400 fixed to the frame structure 101. The load-bearing surface 105 of the support element may comprise a gripping surface 1100 selected from the group consisting of elastomer coated surfaces, grooves, curved surfaces, and rough surfaces. The gripping surface may provide more friction for better support and control of an object 104 being gripped.

Figure 12:
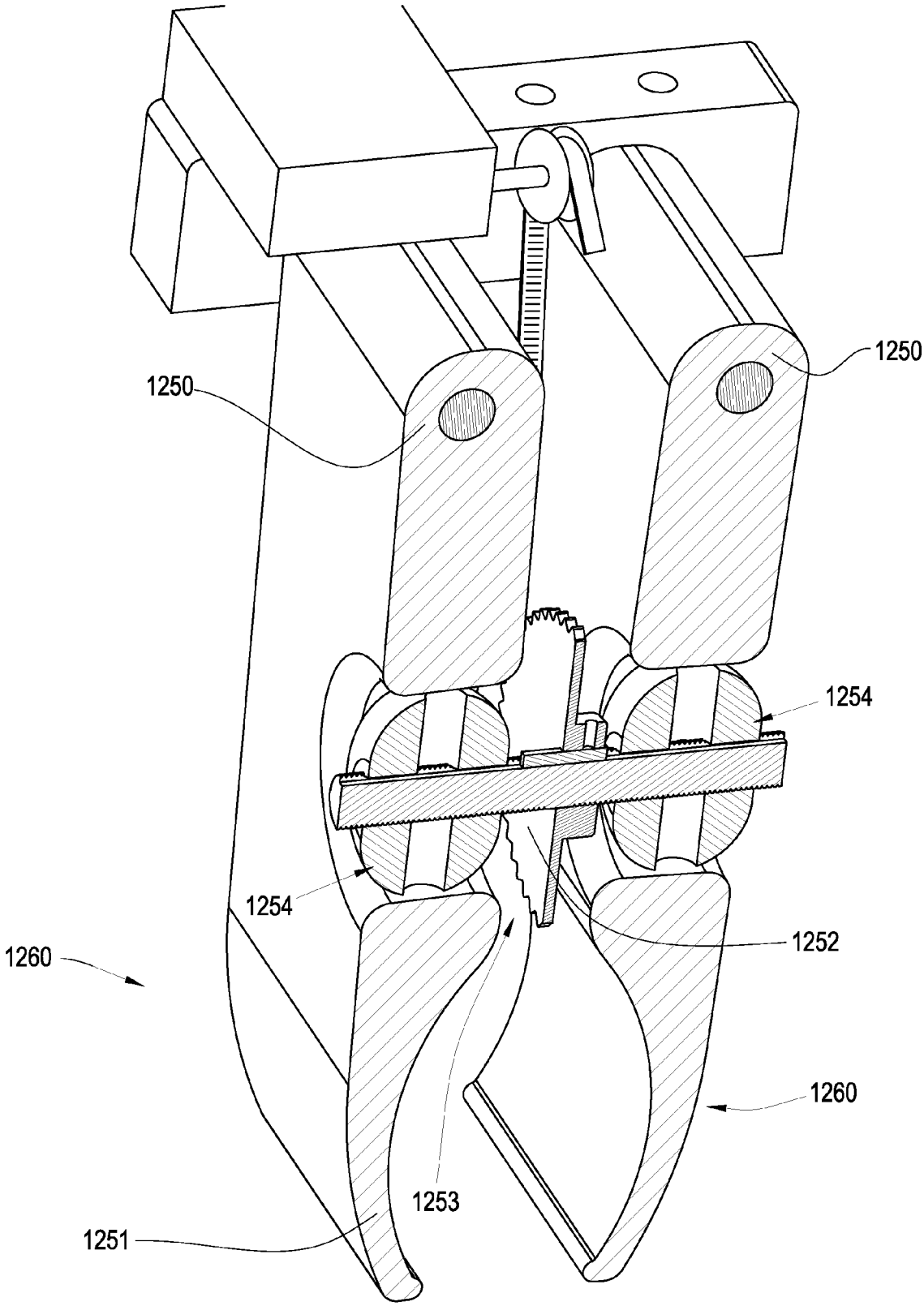
FIG. 12 is a cross-sectional diagram of an embodiment of a clamping assembly.

FIG. 12 is a cross-sectional diagram of an embodiment of a clamping assembly 1 10. The clamping assembly 110 may comprise opposed jaws 1260 each comprising a ball and socket apparatus 1254 intermediate a clamp end 1250 and a pivot end 1251 attached to the frame structure 101. The ball and socket apparatuses are connected by a gear assembly 1253 comprising a primary gear 1252 in mechanical communication with a power source 108, wherein the jaws 1260 are actuated in accordance with the rotation of the primary gear 1252. Such a clamping assembly is described in U.S. patent application Ser. No. 11/179,975, which is herein incorporated by reference for all that it discloses.

Figure 13:
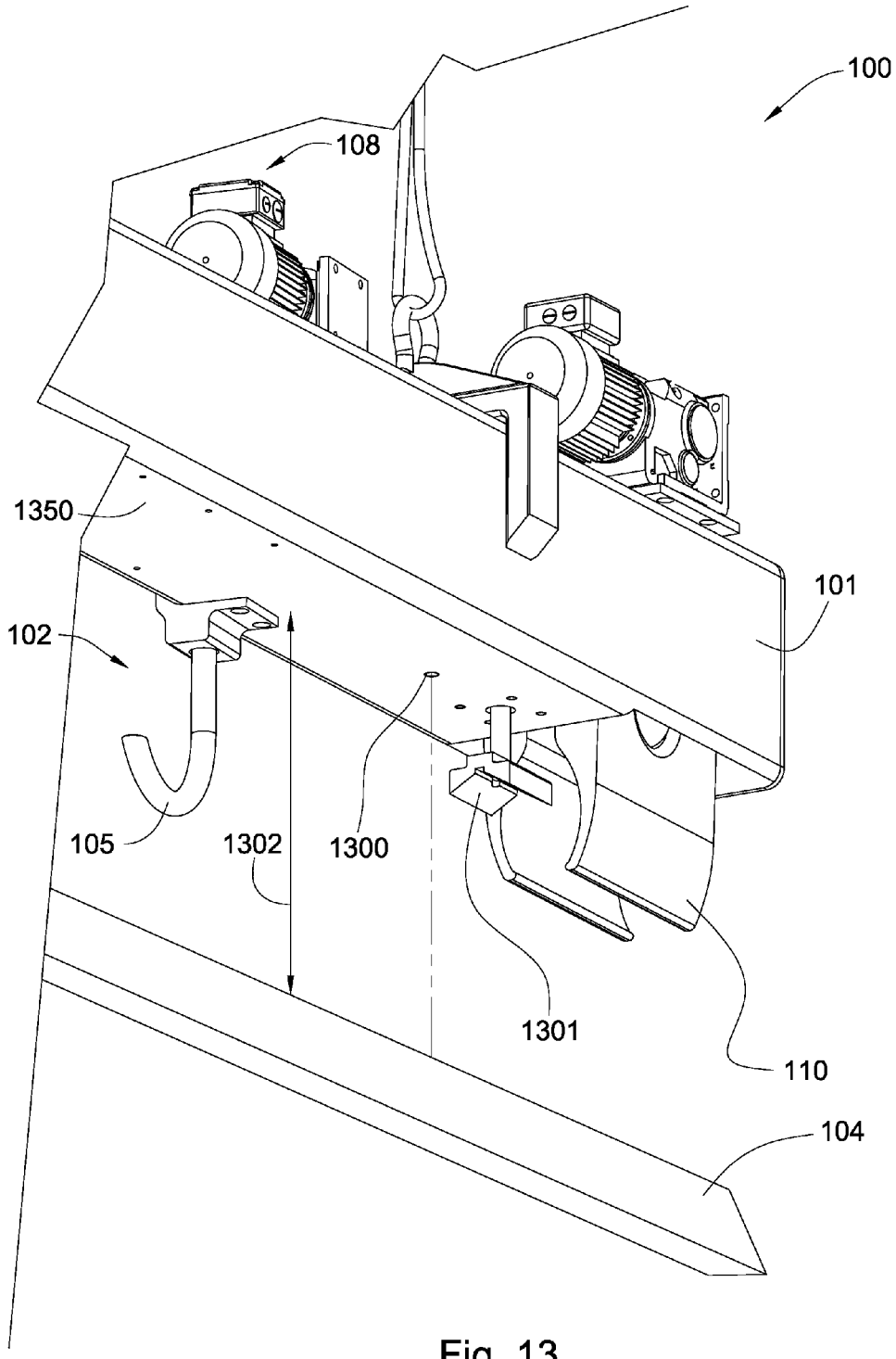
FIG. 13 is a perspective diagram of an embodiment of a lifting assembly comprising a plurality of sensors.

FIG. 13 discloses an embodiment of a lifting assembly 100 comprising a plurality of sensors. A stabilizing member 1301 may be secured to an underside 1350 of a frame structure 101 which may add one or more points of contact between a clamping assembly 110, support element 102 and an object 104. A sensor 1300 may be disposed within the frame structure to determine the proximity 1302 of the object to the frame structure. A pressure sensor may be disposed within the stabilizing member which may act in conjunction with the optical sensor to monitor the position of the object, as well as monitor its stability.

After the object 104 has been firmly gripped by the clamping assembly 110, electronic equipment receiving output from the sensors may turn on the power source 108 actuating the movement of the support element 102. The load-bearing surface 105 may move into a position underneath the object, thereby providing extra support for the object.

Figure 14:
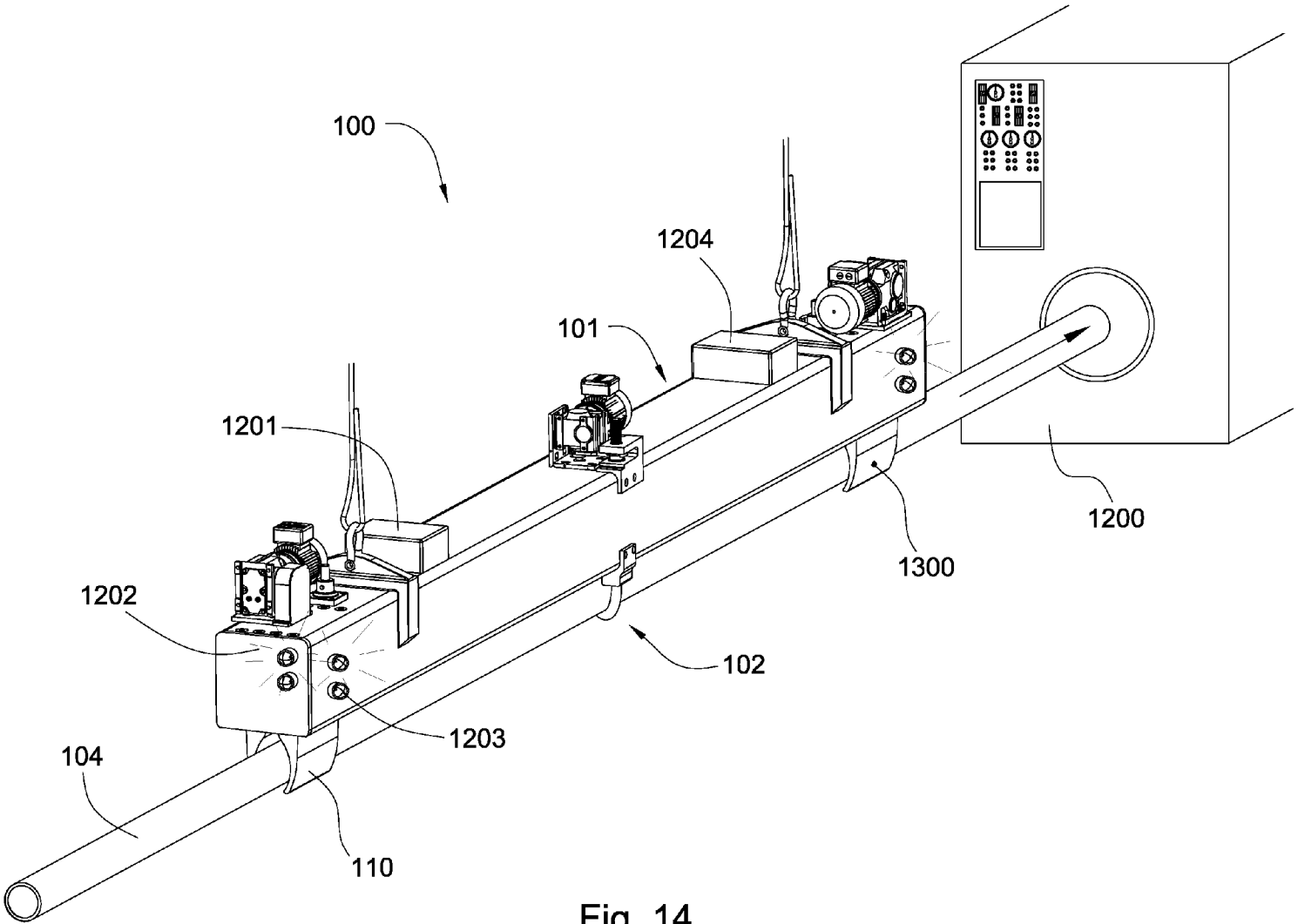
FIG. 14 is a perspective diagram of another embodiment of a lifting assembly.

In FIG. 14, the lifting assembly 100 may comprise a closed-loop system, wherein a frame structure 101 may comprise clamping assemblies 110 and a single translatable support element 102. The frame structure may also comprise electronic equipment selected from the group consisting of control units 1201, sensors 1300, power sources 108, indicators 1202, 1203, and memory. The electronic equipment may be designed to control the actions of the clamping assemblies or the translatable support element. In one embodiment, the lifting assembly may be able to grip an object 104 while inserting it into a machine such as a lathe 1200.

The control unit 1201 may receive operating instructions from an input device selected from the group consisting of controllers, remote controls, radio controls, sensors, memory, and computers. The operating instructions may be converted into signals to turn on and off the power sources 108 of the lifting assembly 100.

The lifting assembly 100 may comprise memory 1204. The memory may store operating instructions for routine tasks. Indicators 1202, 1203 may be used to indicate a good or bad grip or warn an operator or others nearby of danger such as a power failure or slippage of the object. The indicators may be an optical or acoustic source. This may allow an operator, such as an IntelliLift™ operator, to control numerous lifting assemblies 100 over a network from a single location. This may be advantageous because of the reduction of man hours required to operate the lifting assembly. Further, having a remote operator may reduce the need for men to handle hazardous materials such as corrosive or hot material.

Figure 15:
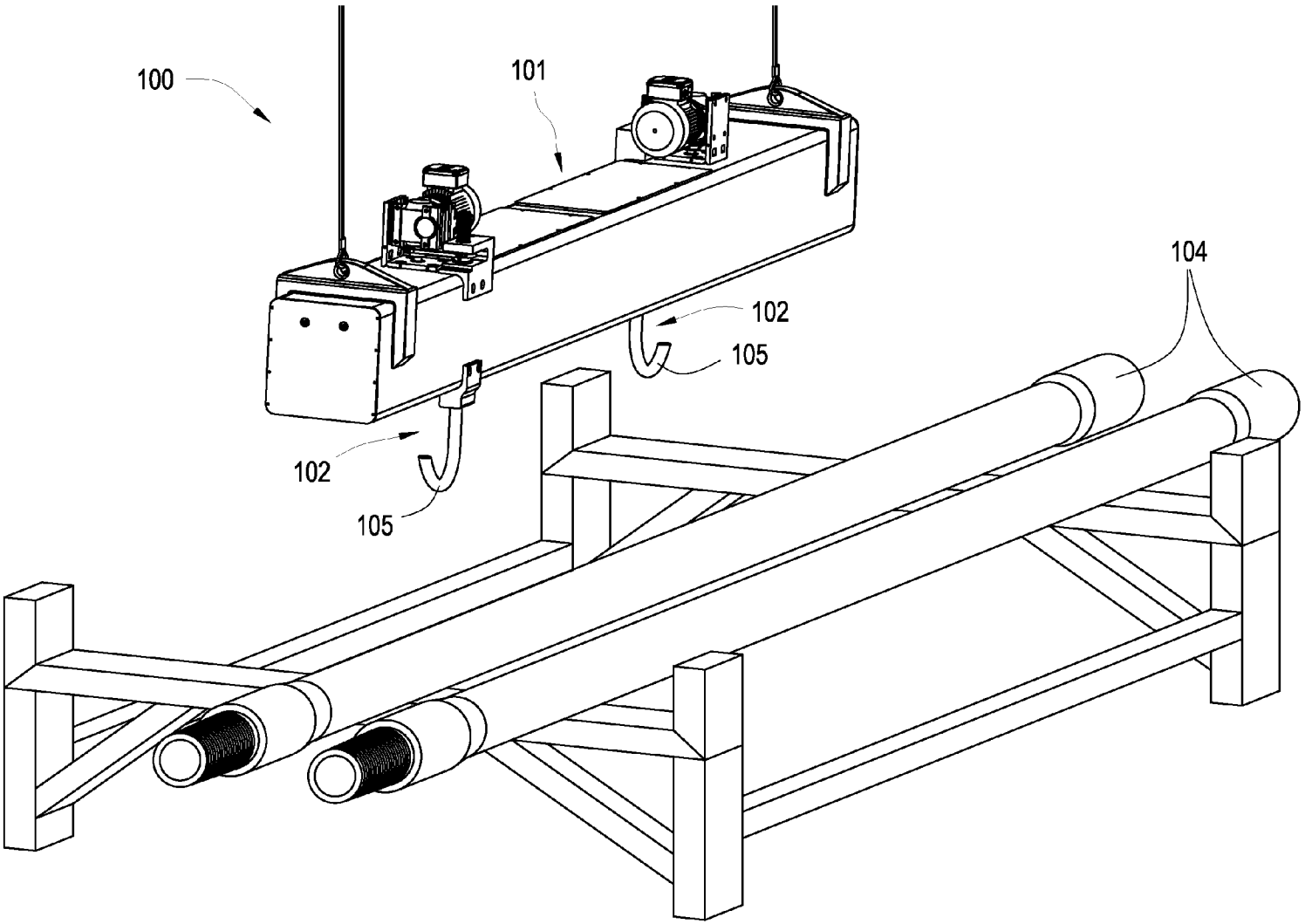
FIG. 15 is a perspective diagram of another embodiment of a lifting assembly.

The translatable support elements 102 may also be used as a primary means of gripping an object, as in FIG. 15. A plurality of objects 104, such as tool string components, may be spaced such that as the lifting assembly 100 is lowered, the support elements may fit in-between the objects when in a disengaged position. The lifting assembly may comprise sensors which determine the proximity of the object to be gripped to the frame structure 101 and which indicate when the load-bearing surfaces 105 may rotate into position underneath the object. Stabilizing members 1301 may also be used to create more contact between the object and the load-bearing surfaces once the support elements have moved to a position where the sensors determine that the object is secure.

Figure 16:
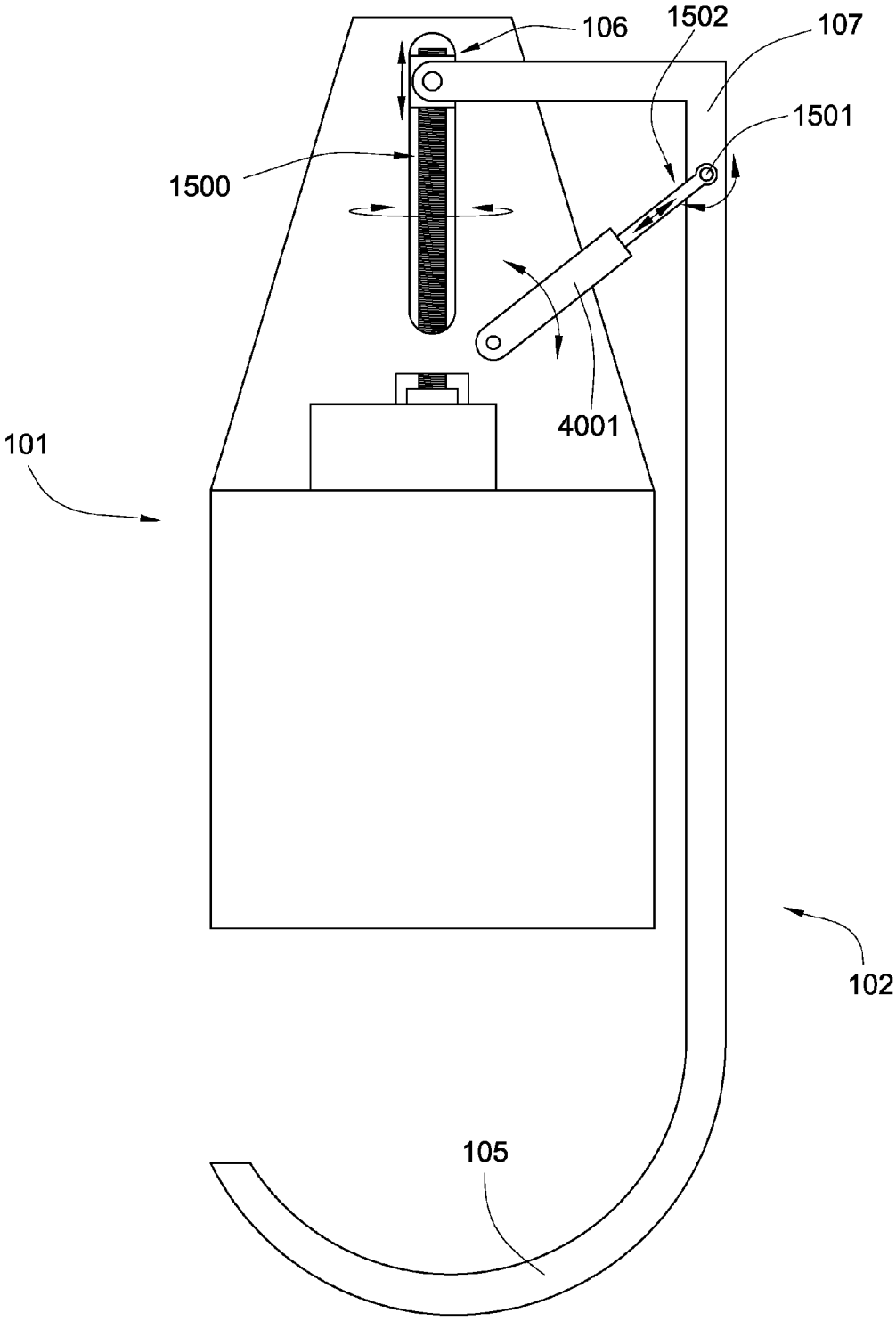
FIG. 16 is a perspective diagram of another embodiment of a translatable support element.

FIG. 16 is an alternate embodiment for a translatable support element 102. A screw-form 106 of the support element may be threadedly connected with a threaded bar 1500 attached to the frame structure 101. A shaft 107 of the support element may be pivotally connected to the screw-form, allowing it to rotate.

A guide 4001 may be pivotally fixed to the frame structure with a portion of the guide also pivotally connected to the shaft 107 of the support element. The guide may 15 be a track inside a hydraulic mechanism with a shaft 1502 inside the track, the shaft 1502 of the guide being the portion pivotally connected to the shaft 107 of the support element. In some embodiments, there may be a plurality of guides.

The support element 102 may be translated vertically with the movement of the screw-form along the threaded bar. As the screw-form 106 moves up and down along the threaded bar 1500, the guide 400 may adjust to allow the support element to move up and down without any azimuthal rotation.

The support element may also rotate about a pivot point 1501 created by the connection between the support element 102 and the guide 400. As the screw-form 106 moves down along the threaded bar 1500, the shaft 1502 of the guide extends outward to allow the pivot point to move, causing the load-bearing surface 105 to rotate away from the frame structure 101. The load-bearing surface may also rotate toward the frame structure as the guide retracts inward and the screw-form moves up along the threaded bar.

Figure 17:
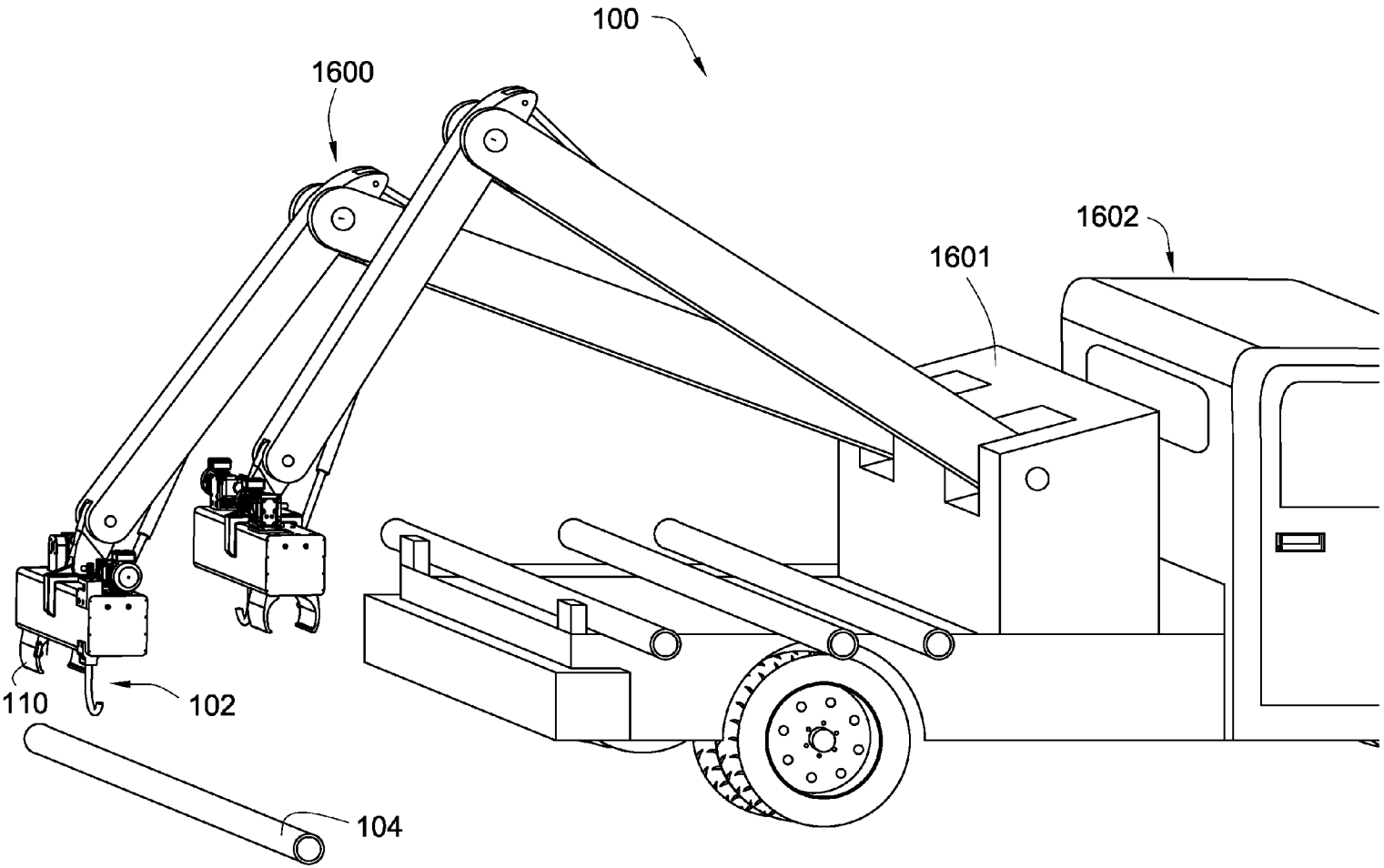
FIG. 17 is a perspective diagram of another embodiment of a lifting assembly.

FIG. 17 discloses another embodiment of a lifting assembly 100. The lifting assembly may comprise at least one frame structure 101 comprising a clamping assembly 110 and a translatable support element 102. Each frame structure may be controlled by adjustable arms 1600 pivotally connected to a base 1601 which may be securely fastened to a flatbed truck 1602. The arms may be powered by hydraulics, engines, or motors. This embodiment may be useful for loading and unloading objects 104 such as tool string components onto and off of the flatbed truck.

Figure 18:
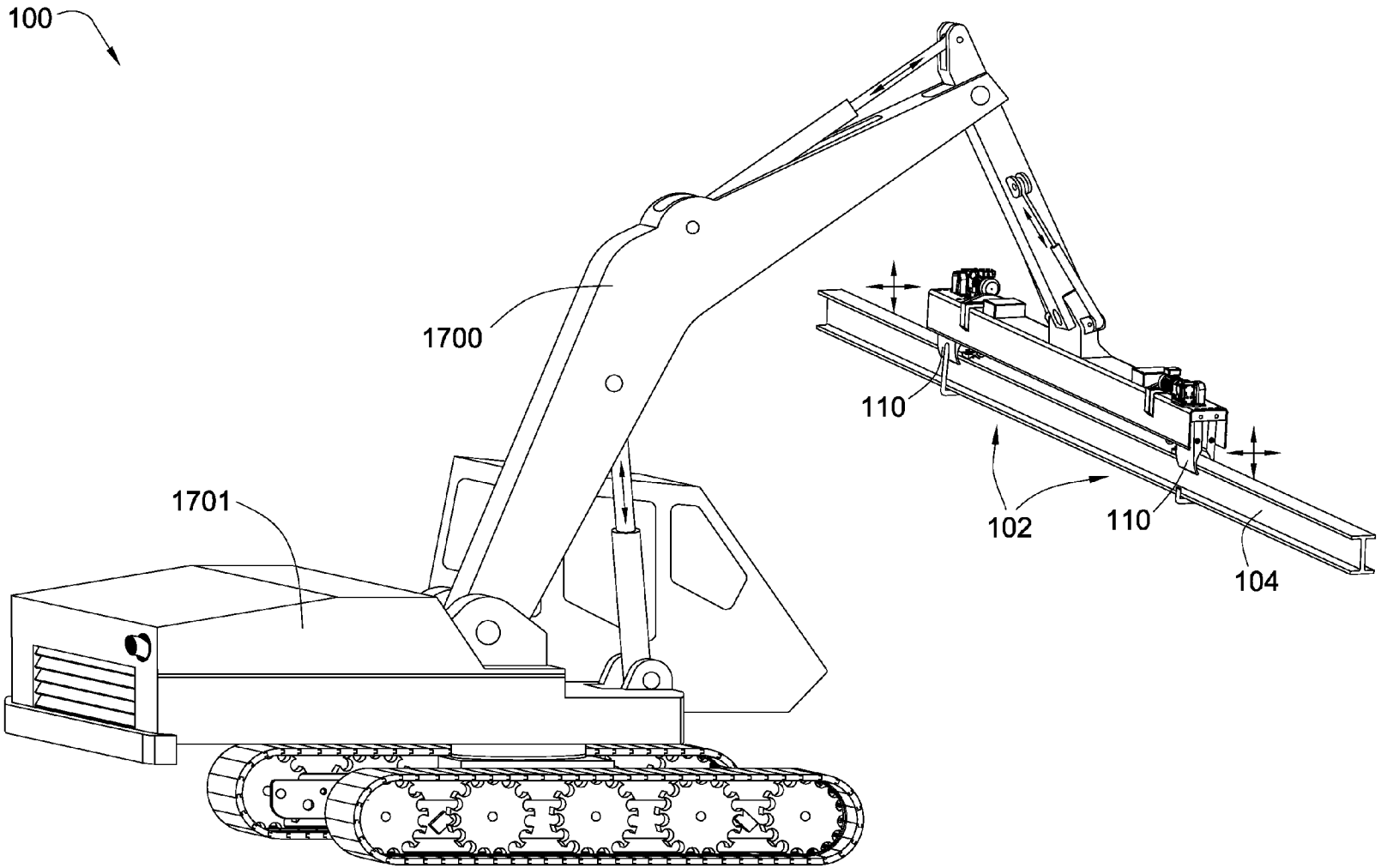
FIG. 18 is a perspective diagram of another embodiment of a lifting assembly.

FIG. 18 is a perspective diagram of another embodiment of a lifting assembly 100 comprising clamping assemblies 110 and two translatable support elements. The lifting assembly comprises a mobile base 1701 and an adjustable arm 1700. The lifting assembly may grip objects 104 of varying size, shape, and weight and transport them from one location to another location.

Figure 19:
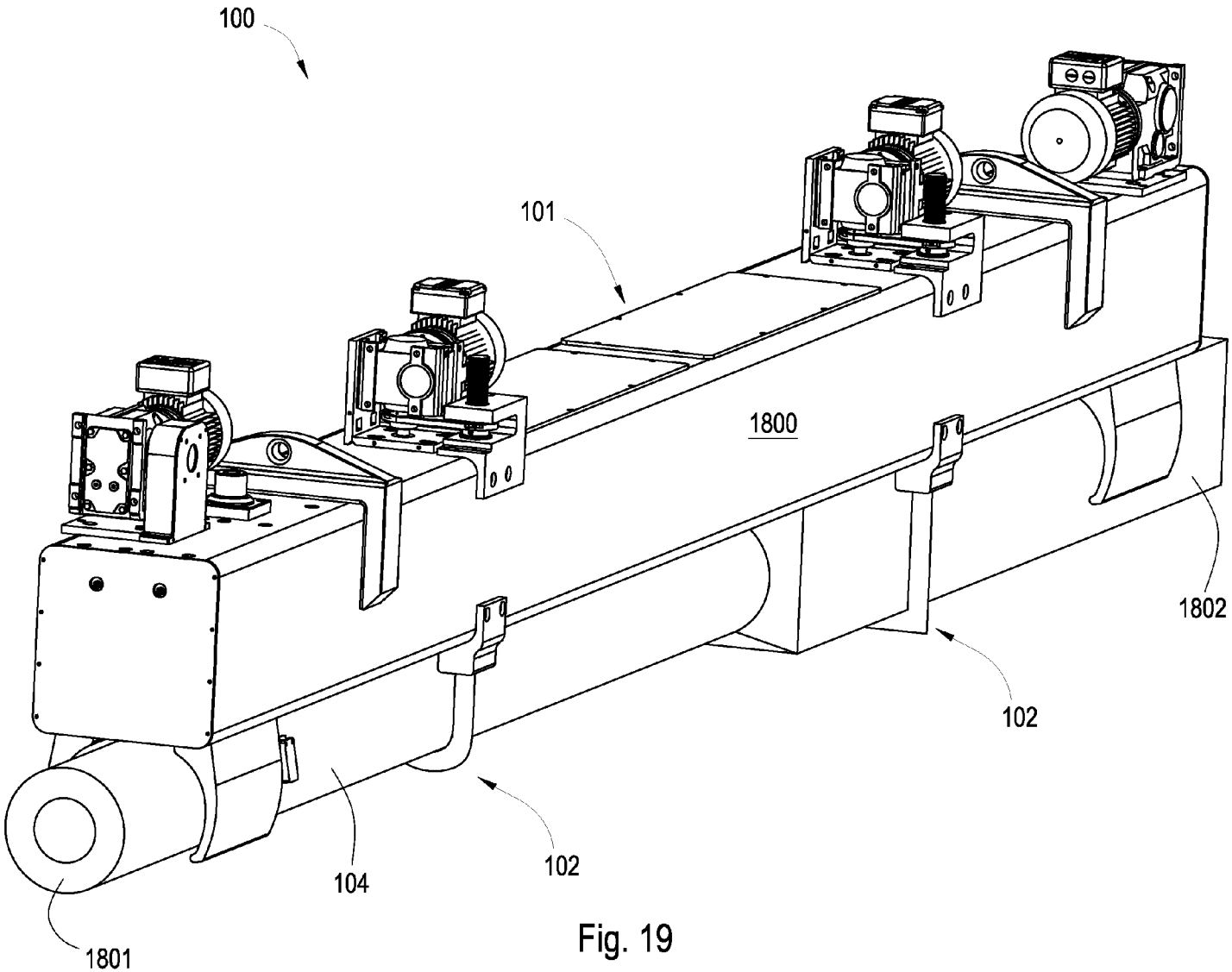
FIG. 19 is a perspective diagram of another embodiment of a lifting assembly.

FIG. 19 is a perspective diagram of another embodiment of a lifting assembly 100. The lifting assembly may comprise translatable support elements 102 secured to a like side 1800 of a frame structure 101, being oriented in the same direction. Each individual support element may also comprise any shape, size, or length, which may be advantageous when gripping objects 104 which vary in size, shape, or weight from one end to another.

Figure 20:
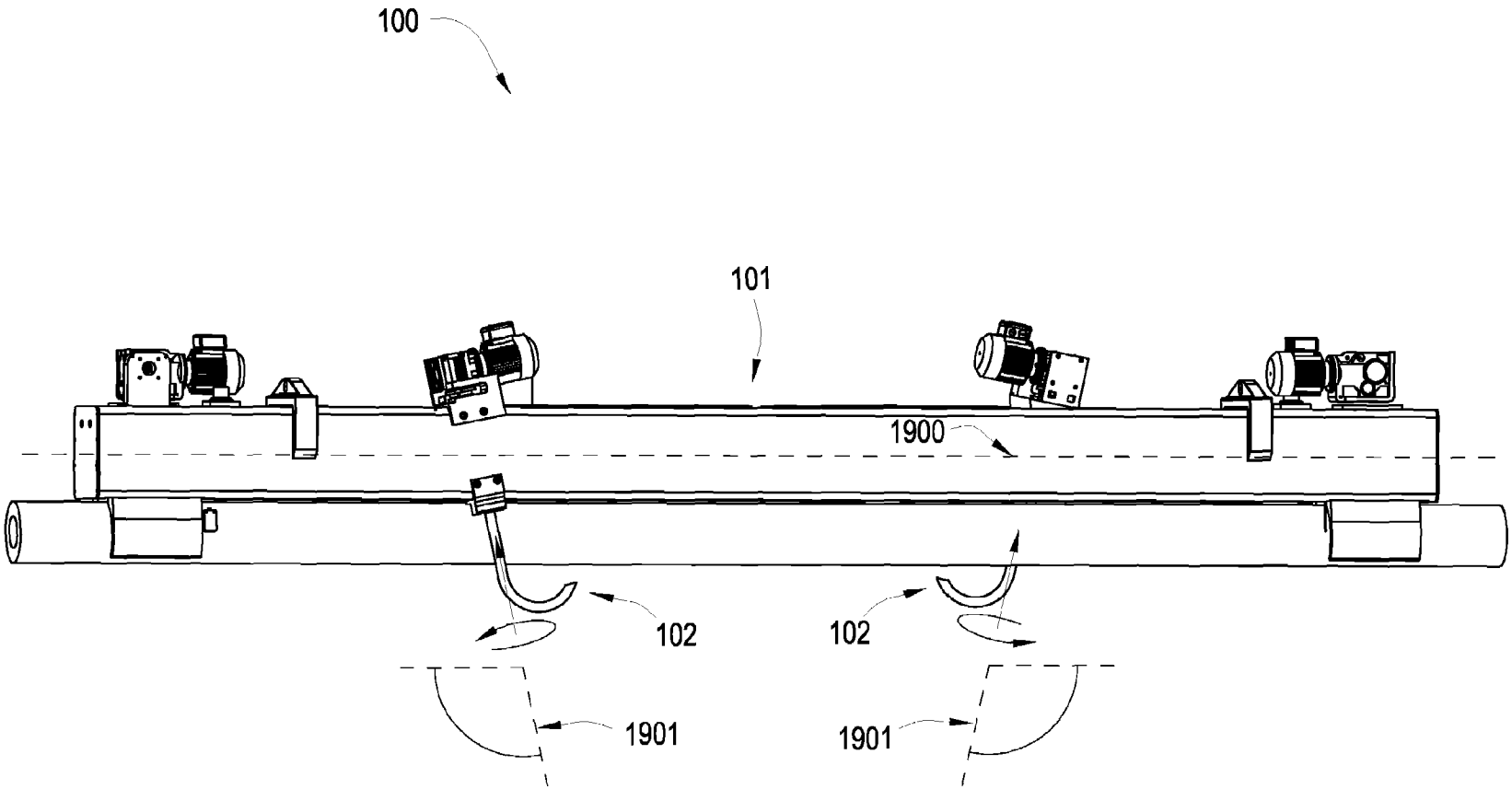
FIG. 20 is a perspective diagram of another embodiment of a lifting assembly.

FIG. 20 is a perspective diagram of another embodiment of a lifting assembly 100 wherein the frame structure 101 comprises an axial length 1900 and translatable support elements 102. The support elements may be adapted to translate along an axis 1901 offset from the axial length by 45 to 135 degrees by fixing the power sources 108, gears 103, or guides 400 at an angle relative to the frame structure 101. In some embodiments of the present invention, the support elements also with the power source, gears, and guides, may be able to pivot along the length of the frame structure and adjust the angle.

Whereas the present invention has been described in particular relation to the drawings attached hereto, it should be understood that other and further modifications apart from those shown or suggested herein, may be made within the scope and spirit of the present invention.

What is claimed is:

1. A lifting assembly, comprising:

a frame structure comprising a translatable support element comprising a load-bearing surface and a screw-form;

the screw-form being threadedly connected to a gear in mechanical communication with a power source;

the load-bearing surface being fixed to a shaft of the translatable support element and at least a portion of the load-bearing surface being angularly oriented with respect to the shaft; and a guide comprising at least one end fixed to the frame structure and adapted to adjust the rotational orientation of the load-bearing surface;

wherein the guide is a recess formed in a sleeve disposed around the shaft of the translatable support element and adapted to receive a guide pin fixed to the shaft.

2. The lifting assembly of claim 1, wherein the power source is fixed to the frame structure.

3. The lifting assembly of claim 1, wherein the power source comprises a motor or hydraulics.

4. The lifting assembly of claim 1, wherein the lifting assembly further comprises at least one clamping assembly also attached to the frame structure.

5. The lifting assembly of claim 1, wherein the assembly comprises opposed jaws each comprising a ball and socket apparatus intermediate a clamp end and a pivot end attached to a frame structure; the ball and socket apparatuses are connected by a gear assembly comprising a primary gear in mechanical communication with a second power source; and wherein, the jaws are actuated in accordance with the rotation of the primary gear.

6. The lifting assembly of claim 1, wherein at least one sensor is attached to the frame structure adjacent to the support element and is adapted to determine a characteristic of the support element.

7. The lifting assembly of claim 6, wherein the at least one sensor is a pressure sensor, a position sensor, a torque sensor or combinations thereof.

8. The lifting assembly of claim 6, wherein the at least one sensor is part of a closed loop system.

9. The lifting assembly of claim 1, wherein the guide is adapted to rotate the shaft a full turn, a half turn, a quarter turn, a fractional turn, or combinations thereof

10. The lifting assembly of claim 1, wherein the load-bearing surface is supported by a pivot and a guide pin positioned within the guide is adapted to move the load-bearing surface.

11. The lifting assembly of claim 1, wherein the gear is in mechanical communication with the power source via secondary gears, belts, bands, wheels, pulleys, chains, ropes, rods, shafts or combinations thereof.

12. The lifting assembly of claim 1, wherein the load-bearing surface is angularly fixed to the shaft at 5 to 145 degrees.

13. The lifting assembly of claim 1, wherein the frame structure comprises an axial length and the translatable support element is adapted to translate along an axis offset from the axial length by 45 to 135 degrees.

14. The lifting assembly of claim 13, wherein the offset axis is normal to the axial length.

15. The lifting assembly of claim 1, wherein the frame structure comprises a stabilizing element fixed to its underside.

16. The lifting assembly of claim 1, wherein the load-bearing surface comprises a gripping surface selected from the group consisting of elastomer coated surfaces, grooved surfaces, curved surfaces, and rough surfaces.

17. A lifting assembly, comprising:

a frame structure comprising opposing translatable support elements, each comprising a load-bearing surface and a screw-form;

the screw-form being threadedly connected to a gear in mechanical communication with a power source;

the load-bearing surface being fixed and angularly oriented with respect to a shaft of the translatable support element; and a guide comprising at least one end fixed to the frame structure and adapted to adjust the rotational orientation of the load-bearing surface;

wherein the guide is a recess formed in a sleeve disposed around the shaft of the translatable support element and adapted to receive a guide pin fixed to the shaft.

* * * * *